US010190052B2

(12) United States Patent
Kirchmeier et al.

(10) Patent No.: US 10,190,052 B2
(45) Date of Patent: Jan. 29, 2019

(54) DEVICE AND METHOD FOR REGULATING AND CONTROLLING THE GAS PRESSURE

(71) Applicant: DMT GMBH & CO. KG, Essen (DE)

(72) Inventors: Martin Kirchmeier, Hattingen (DE); Michael Bohn, Lunen (DE); Manfred Danreiter, Gelsenkirchen (DE); Franz Liesewitz, Muehlheim (DE); Drazen Gajic, Wermelskirchen (DE)

(73) Assignee: DMT GMBH & CO. KG (DE)

( * ) Notice: Subject to any disclaimer, the term of this patent is extended or adjusted under 35 U.S.C. 154(b) by 393 days.

(21) Appl. No.: 14/651,568

(22) PCT Filed: Oct. 10, 2013

(86) PCT No.: PCT/EP2013/003052
§ 371 (c)(1),
(2) Date: Jun. 11, 2015

(87) PCT Pub. No.: WO2014/090353
PCT Pub. Date: Jun. 19, 2014

(65) Prior Publication Data

US 2015/0337205 A1 Nov. 26, 2015

(30) Foreign Application Priority Data

Dec. 14, 2012 (EP) ..... 12008356

(51) Int. Cl.
*C10B 27/06* (2006.01)

(52) U.S. Cl.
CPC ..... *C10B 27/06* (2013.01)

(58) Field of Classification Search
CPC ..... C10B 29/00; C10B 27/06; C10B 27/02; C10B 27/04
See application file for complete search history.

(56) References Cited

U.S. PATENT DOCUMENTS 1,516,432 A * 11/1924 Hilliard ..... C10B 27/06 202/256
1,943,562 A * 1/1934 Still ..... C10B 27/02 202/257

(Continued)

FOREIGN PATENT DOCUMENTS

CN 1083847 A 3/1994
CN 201462118 U 5/2010

(Continued)

OTHER PUBLICATIONS

Espacenet translation of DE366274C Eng (H. H. Burgemeister, Jan. 1923), obtained Aug. 10, 2017.*

(Continued)

*Primary Examiner* — Renee Robinson
*Assistant Examiner* — Gabriel E Gitman
(74) *Attorney, Agent, or Firm* — Brooks Kushman P.C.

(57) ABSTRACT

A device and a method are provided for regulating and controlling individual gas pressure of individual ovens of a coke oven battery, in the case of which a rising-pipe bend projects, preferably from above, into a collecting main. The lower end thereof is associated with an immersion pipe via a water labyrinth seal. The immersion pipe is supported such that it is vertically adjustable by means of an actuator, and an immersion cup is located preferably below the immersion pipe. The rising-pipe bend has arranged therein a sleeve, the lower end of which is connected via at least one conduit to the water labyrinth seal. A water supply for feeding the water labyrinth seal and the actuator are provided at the top, outside the rising-pipe bend. Regulation of the gas pressure is accomplished by different immersion depths of the immersion pipe and the constant water level in the immersion cup.

29 Claims, 6 Drawing Sheets

(56) References Cited

U.S. PATENT DOCUMENTS

| | | | | |
|---|---|---|---|---|
| 2,027,548 | A * | 1/1936 | McIntire | C10B 27/06 202/254 |
| 5,609,731 | A * | 3/1997 | Giertz | C10B 27/06 137/14 |
| 7,097,743 | B2 | 8/2006 | Krebber et al. | |
| 8,926,800 | B2 | 1/2015 | Krebber et al. | |
| 2004/0129553 | A1 | 7/2004 | Krebber et al. | |
| 2014/0054157 | A1 | 2/2014 | Krebber et al. | |

FOREIGN PATENT DOCUMENTS

| | | | | | |
|---|---|---|---|---|---|
| CN | 201737893 | U | * | 2/2011 | |
| CN | 201737893 | U | | 2/2011 | |
| CN | 102268269 | A | | 12/2011 | |
| CN | 102449116 | A | | 5/2012 | |
| CN | 102786952 | A | | 11/2012 | |
| DE | 366274 | C | * | 1/1923 | |
| DE | 366274 | C | | 1/1923 | |
| DE | 102010047025 | | * | 4/2012 | C10B 27/06 |
| DE | WO2012041469 | A2 | * | 4/2012 | C10B 27/06 |
| EP | 0649455 | B1 | | 1/1998 | |
| JP | 2001152157 | A | | 6/2001 | |
| RU | 2388788 | C2 | | 5/2010 | |
| SU | 41939 | A | | 2/1935 | |
| TW | 546364 | B | | 8/2003 | |
| WO | 9401513 | A1 | | 1/1994 | |
| WO | 02066576 | A1 | | 8/2002 | |
| WO | 2012031667 | A1 | | 3/2012 | |

OTHER PUBLICATIONS

WO2012041469A2_ENG (Espacenet translation of Uebershaer). (Year: 2012).*

DE366274C_Eng (Espacenet machine translation of DE366274C) (Year: 1923).*

CN201737893U_Eng (Espacenet machine translation of CN201737893U) (Year: 2011).*

Chinese Office Action dated Apr. 18, 2016, Application No. 201380065369.4, 6 Pages.

Korean Office Action dated Aug. 16, 2016, Application No. 10-2015-7017692, Applicant DMT GmbH & Co. KG, 6 Pages.

Russian Office Action dated Aug. 30, 2016, Application No. 2015118245/05(028331), Applicant DMTGMBH & Co. KG, DE, 6 Pages.

English Translation of Ukrainian Office Action, Application No. a 2015 06794, Applicant DMT GMBH & Co, KG (DE), 1 Page.

Taiwan Office Action dated Jun. 15, 2015, Application No. 10420780050, 4 Pages.

Chinese Third Office Action dated May 22, 2017, Application No. 201380065369.4, 6 Pages.

European Search Report dated Jun. 3, 2013, Application No. EP 12 00 8356, 4 Pages.

Dr. Frank Sowa, "Coke Oven Pressure Regulation—The next Generation PROven® NG", Presentation at AISTech17 Conference May 5-8, 2014 in Indianapolis, IN, USA, Published May 2014,11 Pages.

European Commission, Best Available Techniques (BAT) Reference Document for Iron and Steel Production, Industrial Emissions Directive 2010/75/EU (Integrated Pollution Prevention and Control), Joint Research Centre, Institute for Protective Technological Studies, Sustainable Production and Consumption Unit, European IPPC Bureau, Published Mar. 2012, pp. 247-251.

Helenio Resende Silva Junior, Giovanni Siri, "Retrofitting "Individual Coke Over Pressure Control" Without Stopping Production", 19a Conferencia del Acero IAS, 19th IAS Steel Conference IAS, 2013, Rosario, Santa Fe, Argentina, Published Oct. 2013, pp. 541-550.

Kuhn-Gajdzik J., Krebber F., Uberschar K, Diephaus M., Hegner F., "The Latest Developments on the EnviBAT™ Pressure Regulation System", AISTech 2015 Proceedings © 2015 by AIST, Published May 2015 pp. 147-153.

* cited by examiner

DEVICE AND METHOD FOR REGULATING AND CONTROLLING THE GAS PRESSURE

CROSS-REFERENCE TO RELATED APPLICATIONS

This application is a U.S. national phase of PCT Application No. PCT/EP2013/003052 filed Oct. 10, 2013, which claims priority to European Application No. 12008356.3 filed Dec. 14, 2012, the disclosures of which are incorporated in their entirety by reference herein.

TECHNICAL FIELD

The present invention relates to a device and a method for regulating or controlling the individual gas pressure of individual ovens of a coke oven battery.

BACKGROUND

A device of the type in question is known from EP 0 649 455. The reference discloses a plurality of embodiments, among which the embodiment according to FIG. 10 is commented on.

In this embodiment a vertical portion of the rising-pipe bend projects into the collecting main from above. The lower end of this portion has provided thereon a water seal, by means of which said portion is sealed off from an immersion pipe extending vertically below the rising-pipe bend in a vertically adjustable manner. Within the rising-pipe bend, trickling water is supplied, which is intended to cool down the gas and which is finally collected in the collecting main sump. Above the water labyrinth seal, water nozzles are provided, so as to keep the water level high within the water labyrinth seal and cause the above-mentioned sealing effect.

The water labyrinth seal is open at the top, whereby contaminations may accumulate therein, which may impede the flow of water and deteriorate the flushing effect of the water labyrinth seal.

The immersion pipe projects at the lower end thereof at least partially into the collecting main sump.

The gas pressure is to be regulated by raising and lowering the immersion pipe.

Immersing the immersion pipe into the collecting main is, however, disadvantageous, since condensates and solid matter normally accumulate in a non-uniform manner in the collecting main, whereby different water levels may be caused. The immersion pipe will be contaminated when it comes into contact with the condensates. Non-uniform accumulations in the collecting main and the lifting movement of the device may cause waves on the water surface, which have a negative influence on pressure regulation.

The water level in the collecting main can only be determined theoretically, the actual water level is unknown and would have to be determined by additional measurements. The extension of the rising-pipe bend and the immersion pipe located therebelow lead to an undesirable total height and an additional load, which cannot be accepted in existing coke oven batteries.

The operating device for the immersion pipe can be arranged laterally, above or below. In so doing, the collecting main wall is penetrated, and separate sealing is necessary.

In addition, the reference also discloses differently designed lower end edges of the immersion pipe, which influence the discharge of gas.

Finally, the reference also discloses various embodiments of immersion cups having outflow openings e.g. in the area of the cup bottom. These outflow openings are disadvantageous, since they tend to clog due to the contaminations contained in the water. In order to restore the function these immersion cups must be cleaned periodically, e.g. by flushing, tipping of the cup or tilting and the use of a cleaning mandrel.

SUMMARY

It is an object of the present invention to provide a pressure regulating device as well as a method for allowing the gas pressure to be regulated or controlled easily and reliably. The regulation of the gas pressure takes place via the different degrees of immersion of the immersion pipe into the immersion cup. This leads to a highly reliable regulation, since the immersion cup is always filled with water up to the overflow level, which means that the water level is constant.

It is the object of the present invention to provide a pressure regulating device as well as a method for allowing the gas pressure to be regulated or controlled easily and reliably. According to the present invention, this object is achieved by the features of the characterizing clause of the main claim. The regulation of the gas pressure takes place via the different degrees of immersion of the immersion pipe into the immersion cup. This leads to a highly reliable regulation, since the immersion cup is always filled with water up to the overflow level, which means that the water level is constant.

According to the invention, the sleeve arranged within the rising-pipe bend serves a dual purpose. On the one hand, it has, outside the rising-pipe bend, an actuator for arranging the immersion pipe in a vertically adjustable manner, and, on the other hand, it serves to feed the water seal or the water labyrinth seal provided between the immersion pipe and the rising-pipe bend. Good sealing between the rising-pipe bend and the immersion pipe is accomplished in this way over the entire height of the vertical change of position.

Both the water supplied to the sleeve and the actuator are arranged outside of the rising-pipe bend and are therefore not subjected to the hot gases and the combustible, toxic, aggressive and contaminating components contained therein. These components comprise in particular hydrogen, carbon monoxide, methane and hydrocarbons as well as tar, benzene and naphthalene. This arrangement prevents contamination and increases the operational reliability.

When the device is operation, the coke oven gas flows through the rising-pipe bend downwards in the direction of the collecting main. Since the lower edge of the displaceable immersion pipe is immersed in the water contained in the immersion cup, the coke oven gas must flow through this water for arriving at the collecting main. Depending on the immersion depth of the immersion pipe in the immersion cup, the path length of the gas travelling through the water will vary.

When the immersion depth of the immersion pipe is increased, also the distance to be travelled through the water will increase, i.e. the coke oven gas will have to overcome a higher water pressure in order to flow through the immersion cup. A back pressure builds up in the bend and in the oven, until the pressure is sufficiently high for breaking the water barrier.

The slots, which may be provided in the immersion pipe, represent a direct connection from the interior of the immersion pipe to the collecting main so that the gas will be able to flow into the collecting main without any detour through the water. When the immersion depth of the immersion pipe is increased, the free slot area above the water surface will be reduced. Also this leads to a back pressure, which causes an increase in the pressure prevailing within the oven and the bend.

In practice, part of the coke oven gas flows through the free cross-sectional area of the slots and another part through the water, in the event of little gas flow also exclusively through the water.

The adjustment range of the immersion pipe is large enough for allowing the immersion pipe to be fully withdrawn from the immersion cup. In addition to the possibly existing slot area, an annular gap, through which the coke oven gas can flow, is thus formed between the lower edge of the immersion pipe and the water surface.

During normal operation, the immersion pipe is immersed into the immersion cup to a greater or lesser degree, until the back pressure corresponds to the desired oven pressure. Deep immersion causes an increase in the pressure prevailing in the oven, immersion to a lesser degree causes a decrease in pressure.

When the oven is disconnected, the coke is to be pushed out of the oven, and, to this end, the oven doors are opened. The amount of air (oxygen!) sucked through these large openings into the oven and in the collecting main and consequently into the gas cleaning system would be so large that this may lead to an inflammable mixture. In order to prevent this, the connection between the oven and the collecting main has to be closed.

In order to achieve this, the immersion pipe is immersed into the immersion cup to such an extent that neither the back pressure from the oven nor the suction from the collecting main suffices for breaking the water barrier in the immersion cup. Prior to this, a rising-pipe cover is opened so that the still generated coke oven gas will flow out, ignite and burn u.

After the oven has been pushed, i.e. when the oven is empty, it must be filled with coal for the next coking process (connecting the oven). This is normally done through charging holes provided in the oven roof or by pushing a coal cake in through the oven door. When the coal comes into contact with the hot oven walls, large amounts of a so-called filling gas are formed, and dust is blown up.

This filling gas and dust must be sucked off, so as to prevent them from being emitted in the environment (emission protection). In order to allow the smoothest possible transfer to the collecting main, the pressure regulating device is opened to a maximum degree. To this end, the immersion cup is pivoted away. The water flows out of the cup, and the pivoted cup thus uncovers the full cross-section of the immersion pipe.

The rising-pipe bend normally includes a substantially vertical portion in the area of the collecting main. This allows a turbulence-free flow of the gas to the collecting main. In addition, the vertical portion of the rising-pipe bend allows the sleeve to be easily passed through the bend. At the location of penetration a simple water seal can be provided, whose overflow flows, in turn, into the interior of the rising-pipe bend and is finally supplied to the collecting main.

In addition, it is of advantage when a positioning means for the immersion cup is supported in the interior of the sleeve. This positioning means is thus protected against the hot gases and is not subjected to the above-mentioned risk of contamination through the gas and the suspended solids contained therein. Also the drive for the positioning means can be arranged outside of the rising-pipe bend, and this, in turn, increases the operational reliability. Other than in the case of the prior art, it is here not necessary to pass the operating means through the wall of the collecting main.

It will also be of advantage to implement the positioning means as a tube and to provide a water supply at the upper end thereof. The water serves to cool the tubes and to feed the water of the immersion cup, which is preferably disposed below the immersion pipe. A discharge opening for the water can be provided primarily in the vicinity of the water labyrinth seal of the immersion pipe, the water flowing then downwards on the inner surface of the sleeve and being normally collected in the immersion cup.

Since the immersion pipe normally projects into the immersion cup, the water level within the immersion cup is maintained constantly on the level of the overflow edge. The water is primarily supplied through at least one sprinkling nozzle, which may e.g. be located within the rising-pipe bend. Additional water is, however, introduced via the water seal of the sleeve. Also this water serves to maintain the constant water level within the immersion cup.

Due to the permanent inflow of water, the immersion cup is always filled to the brim. A constant and defined water level is accomplished in this way, which, in contrast to the known prior art, allows a fast and precise regulation of the gas pressure.

Due to the constant overflow of water over the edge of the immersion cup, contaminations are, permanently flushed out. Whereas in the prior art, the immersion cup includes discharge openings which are sometimes narrow and which may clog and get choked, the flow of water in the device according to the present invention takes place over the entire edge of the immersion cup, so that there is no risk of clogging.

When the immersion pipe is horizontally configured at the lower end thereof, gas will be discharged uniformly over the whole circumference. The lower end of the immersion pipe may, however, also be slotted or provided with other regular or irregular termination elements so as to accomplish a smooth discharge of gas.

In order to allow pivoting of the immersion cup, it will be of advantage to fix the cup on one side thereof via at least one supporting point and to pivot it about this supporting point with the aid of the positioning means. For this purpose, it will be advantageous to articulate the lower end of the positioning means on the immersion cup. Also a chain or a rope may be used as a connection.

Another embodiment of the present invention can be so conceived that the device for regulating or controlling the individual gas pressure of individual ovens of a coke oven battery is not associated with the collecting main but with the rising-pipe bend. The rising-pipe bend is provided with a sleeve, which is connected via at least one conduit to the water labyrinth seal at the lower end thereof and which, at the upper end thereof, outside the rising-pipe bend, has a water supply for feeding the water labyrinth seal. The vertical portion of the rising-pipe bend, or rather the extension thereof, may have a diameter which is adapted to that of the device, it may e.g. be broader than the rising pipe itself.

Due to the fact that the device is arranged within the rising pipe, or the above-mentioned extension, the gas pressure can be regulated and controlled independently of the shape of the collecting main. This provides the advantage that the regulation according to the present invention can also be used for small collecting mains, which would otherwise not offer sufficient space for the device.

The present invention is also realized by a method, which is characterized in that an immersion cup located below the immersion pipe is continuously filled with water so that the water flows over an overflow edge and establishes a constant water level with respect to which the lower end of the immersion pipe is adjusted so as to regulate and control the gas pressure.

DESCRIPTION OF THE DRAWINGS

In the following, embodiments according to the disclosure will be described in more detail with reference to the below drawings.

DETAILED DESCRIPTION

Figure 1:
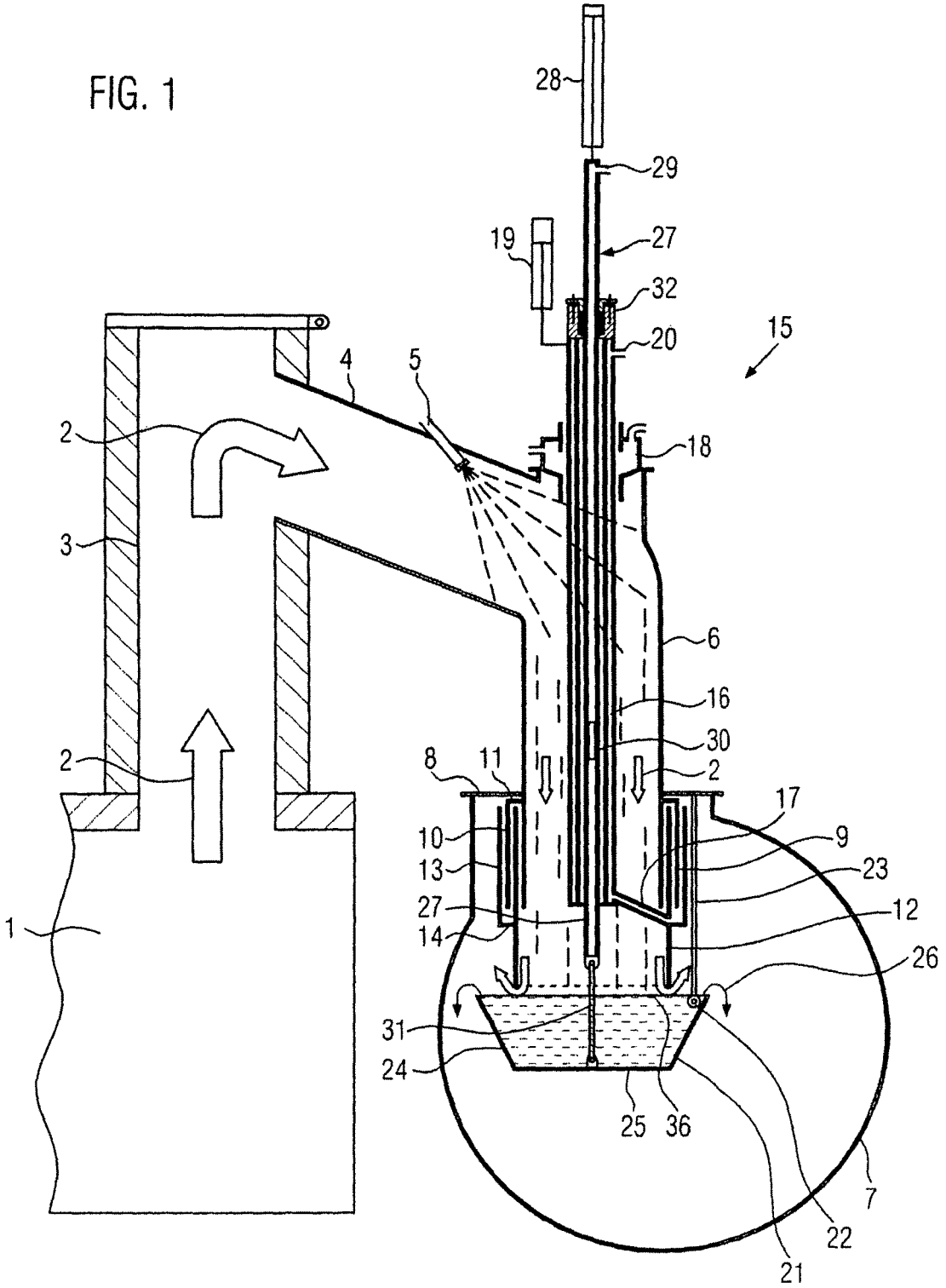
FIG. 1 shows a vertical section through a first embodiment of a device according to the present invention in the raised condition of the immersion pipe.

FIG. 1 shows the vertical section through a pressure regulating device 15 according to the present invention, with a coke oven 1 from which coke oven gas 2 is conducted vertically upwards within a rising pipe 3 when the oven is in operation. The rising pipe has at the upper end thereof an inspection and cleaning flap followed by a rising-pipe bend 4 extending from a point below said flap at an oblique angle downwards. Within the bend at least one sprinkling nozzle 5 is arranged, through which water can be introduced in the bend for cooling the coke oven gas. The rising-pipe bend 4 ends with its vertical portion 6 in the collecting main 7, which has a horizontal closure plate 8 at the top thereof.

The lower end of the rising-pipe bend has arranged thereon a water labyrinth seal 9, which comprises a ring 10 extending coaxially with the rising-pipe bend and connected at the top through a horizontal leg 11 to the vertical portion 6. The bend 4, or rather the vertical portion 6, defines together with the ring 10 a circular space which is open at the bottom and into which an immersion pipe 12 projects, which coaxially surrounds the lower portion of the rising-pipe bend. For completing the water labyrinth seal, the immersion pipe 12 is provided with a ring 13 which, in turn, is arranged coaxially with the immersion pipe and the lower end of which is fixed to the immersion pipe via a horizontal leg 14. The ring 13 defines together with the immersion pipe 12 a circular space which is open at the top and which, for operating the device 15 shown, is filled with water so as to accomplish immersion in water, which allows the immersion pipe to be vertically displaced during operation of the device and which simultaneously guarantees a sealing effect.

Within the vertical portion 6 of the rising-pipe bend 4 a double-walled sleeve 16 is arranged, which is in fluid communication with the circular labyrinth space between the immersion pipe 12 and the ring 13 via at least one connection passage 17. The double-walled sleeve 16 thus terminates at the lower end thereof in the area of the water labyrinth seal 9. Its upper end is located outside of and above the vertical portion 6 of the rising-pipe bend and is sealed off from the rising pipe with the aid of a water seal 18. Outside of the rising pipe, the sleeve 16 is connected to an actuator 19 with the aid of which the sleeve 16 and the immersion pipe 12 are vertically displaceable. In the area of the upper end, the sleeve 16 is additionally provided with a water supply 20 which serves to fill water into the interior of the double-walled sleeve and, via the connection passages 17, also into the water labyrinth seal 9 and to accomplish the above-mentioned vertically variable gas sealing of the immersion pipe from the rising-pipe bend.

Since the water is fed into the water labyrinth seal from below and flows upwards, solid matter is prevented from entering the water labyrinth seal from above. In addition, the continuous flow of water also cleans the interior of the seal and contaminations are flushed out.

Within the collecting main 7 and below the immersion pipe 12, an immersion cup 21 is provided, which can be pivoted on one side thereof via a bearing arrangement 22. The bearing arrangement 22 is arranged on the lower end of a suspension 23, which is fixed e.g. within the collecting main to the closure plate 8.

The immersion cup 21 is broader than the immersion pipe 12 and may be configured as a truncated cone that is open the top. It has lateral walls 24, which are arranged such that they extend e.g. at an oblique angle of 70° relative to the horizontally extending bottom 25. The immersion cup serves to accommodate water supplied thereto e.g. through the nozzle 5, the water supply 20 as well as the water supply 29. The immersion cup is therefore always full to the brim with water when the device is in operation. Since water flows in continuously, the water will flow over the brim into the collecting main, as indicated by arrow 26. The oblique walls prevent turbulences during gas discharge.

Due to the permanent overflow of water over the overflow edge of the immersion cup, the floatable contaminations which may perhaps the contained therein are continuously flushed out. In the prior art, these contaminations remain within the cup, and this necessitates periodic tilting and emptying of the cup.

For holding the immersion cup 21 at the horizontal position shown in FIG. 1 and also for tilting it for the purpose of emptying, a positioning means 27 is used, which is arranged within the double-walled sleeve 16 and which projects beyond said sleeve at the top. Outside of the sleeve, the positioning means 27 is connected to an actuator 28. The positioning means 27 is implemented as a hollow tube and has at the upper end thereof a water supply 29 through which water is conducted downwards.

Through at least one water discharge opening 30, the water can exit the positioning means and enter the interior of the sleeve 16. The water then flows downwards into the immersion cup 21.

The lower end of the positioning means 27 has articulated thereon a connection piece 31, which, in turn, is articulated on the bottom 25 of the immersion cup. The connection piece may also be implemented as a rope or a chain.

The positioning means 27 is sealed off from the double-walled sleeve 16 by a plug seal 32 arranged on the upper end of the sleeve. The actual sealing effect is produced by the water. The plug seal prevents the water from escaping from the sleeve, when a higher water pressure is set. It allows flexible sealing of the movable tubes.

The device 15 shown serves to regulate or control the gas pressure of the coke oven 1. Gases 2 having temperatures of approximately 800° C. exit such an oven. The gas escaping from the coke is cooled down to approximately 80° C. within the rising-pipe bend 4. Cooling down is accomplished by the introduced water, which, however, causes components of the gas, in particular the tar, to condense. This leads to a formation of deposits, the harmful effect of which is to be minimized in the case of the device according to the present invention. In particular, an impairment of the functionality of the operating elements of the device is to be avoided.

In the device according to the present invention, the coke oven gas 2 is conducted via the rising-pipe bend 4 downwards into the vertical portion 6 of the same. The gas is wetted and cooled down by means of the sprinkling nozzle 5, whereupon it flows vertically downwards and is introduced into the immersion cup 21 within the immersion pipe 12. The immersion pipe ends within the water area of the immersion cup and below the water level.

In order to accomplish a smooth discharge of gas from the immersion pipe, it is imaginable to form the lower edge of the immersion pipe unevenly, e.g. by making use of slots, saw teeth, wave elements etc.

The gas exiting the immersion pipe flows through the water of the immersion cup and over the edge of the immersion pipe into the collecting main and is then discharged. The desired pressure regulation is executed by different immersion depths of the immersion pipe.

Figure 2:
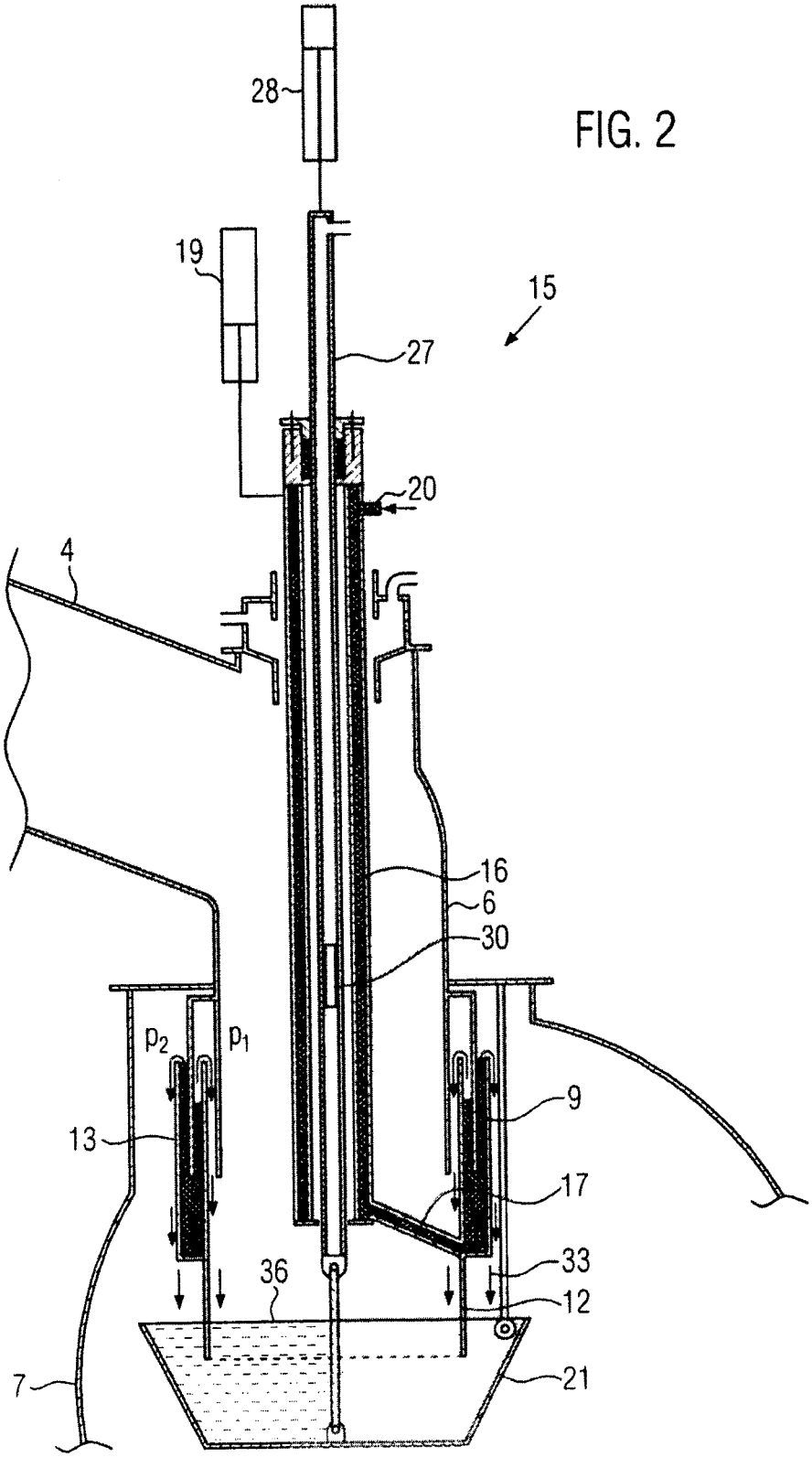
FIG. 2 shows a fragmentary vertical section through the device according to FIG. 1 in the lowered condition of the immersion pipe and indicates the path followed by the water within a sleeve.

FIG. 2 shows the lower end of the immersion pipe 12 projecting into the immersion cup 21, said lower end being located below the water level 36 of the immersion cup 21.

This figure also shows how the water is introduced via the water supply 20 into the double-walled sleeve 16 and transferred from the sleeve, which is closed at the bottom, via the connection passage 17 into the water labyrinth seal 9. At the upper end of the immersion pipe 12, i.e. of the ring 13, the water introduced via the double-walled sleeve 16 spills and flows thus into the immersion cup 21, as indicated by arrow 33. This has the effect that solid matter is flushed out of the water labyrinth seal.

Within the rising-pipe bend 6 the pressure p1 prevails, said pressure being higher than the pressure p2 prevailing in the collecting main.

Figure 3:
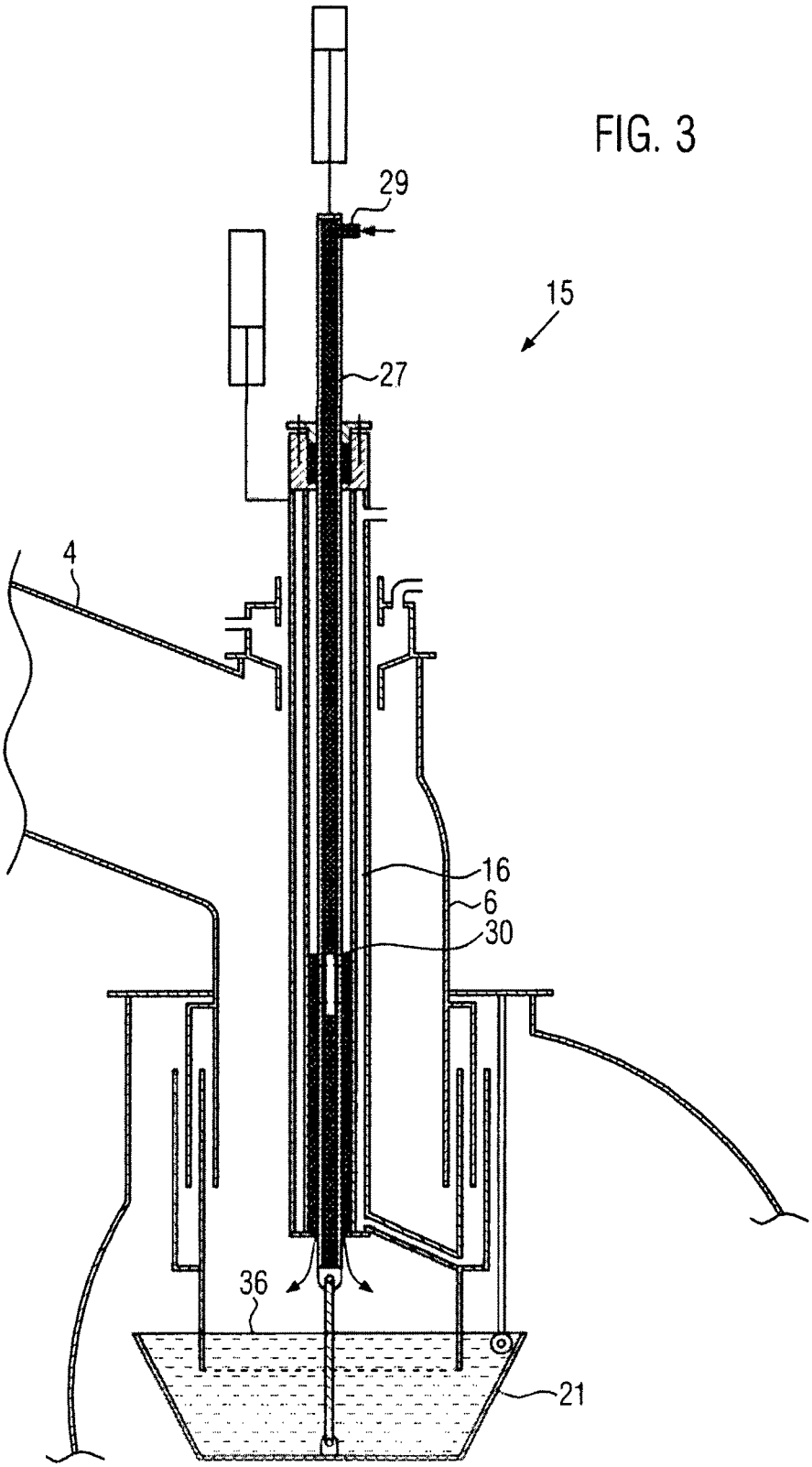
FIG. 3 shows a fragmentary vertical section through the device according to FIG. 1 with indication of the path followed by the water within a positioning means.

FIG. 3 shows how water is introduced via the water supply 29 into the interior of the positioning means 27. The water exits the tube of the positioning means 27 through the opening 30 and flows into the interior of the double-walled sleeve 16. At the lower end of the sleeve 16, the water flows again into the immersion cup 21.

Figure 4:
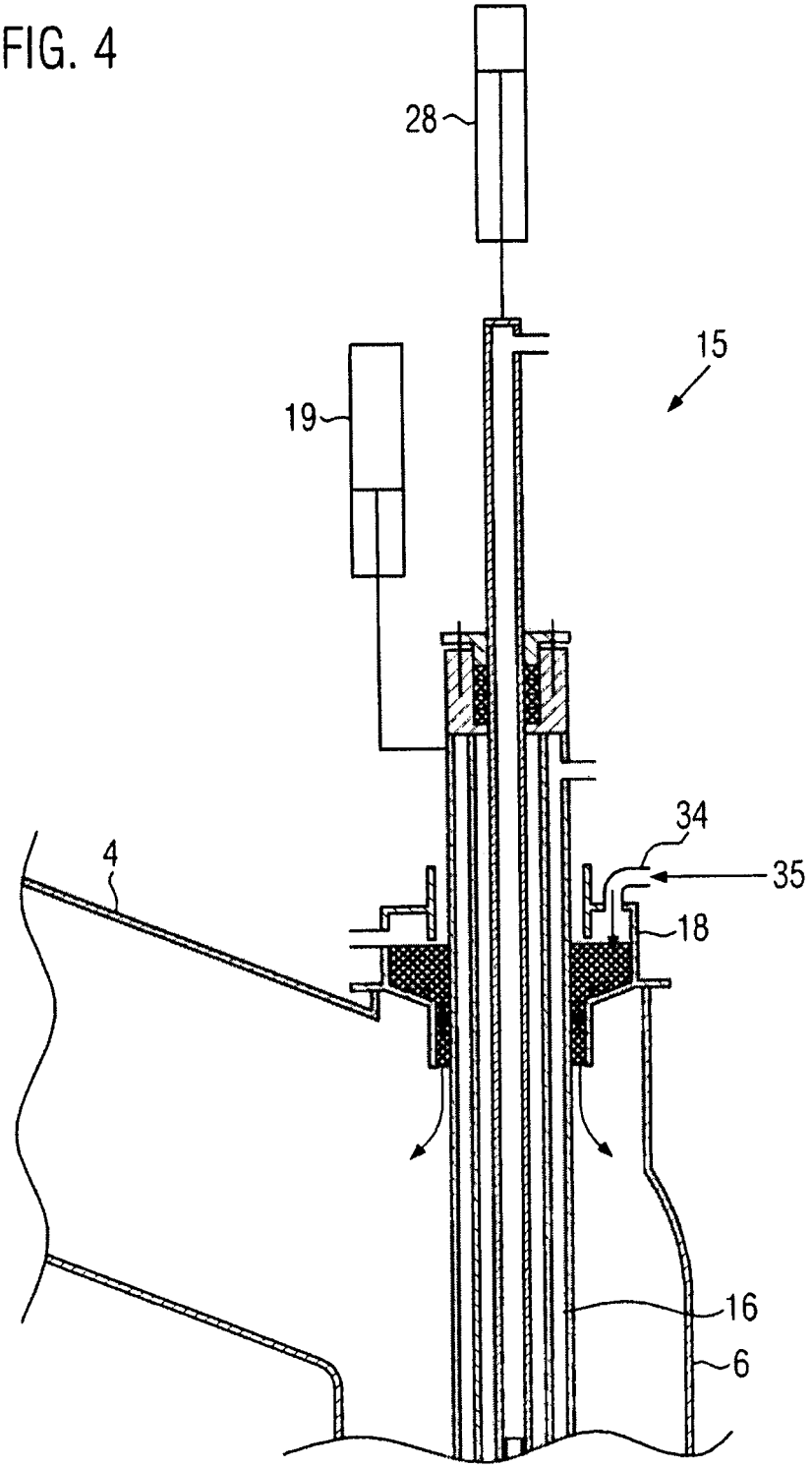
FIG. 4 shows a fragmentary vertical section through the upper part of the device according to FIG. 1 including a representation of a water seal.

FIG. 4 shows the function of the water seal 18. Water flows in the direction of the arrow 35 through the water supply 34 into the interior of the housing, whereby the sleeve 16 is slidingly sealed off from the rising-pipe bend 4 by means of the water. An advantageous effect is achieved by arranging the sleeve and the housing outside of the bend, since lower temperatures and a smaller total height can be accomplished in this way.

Figure 5:
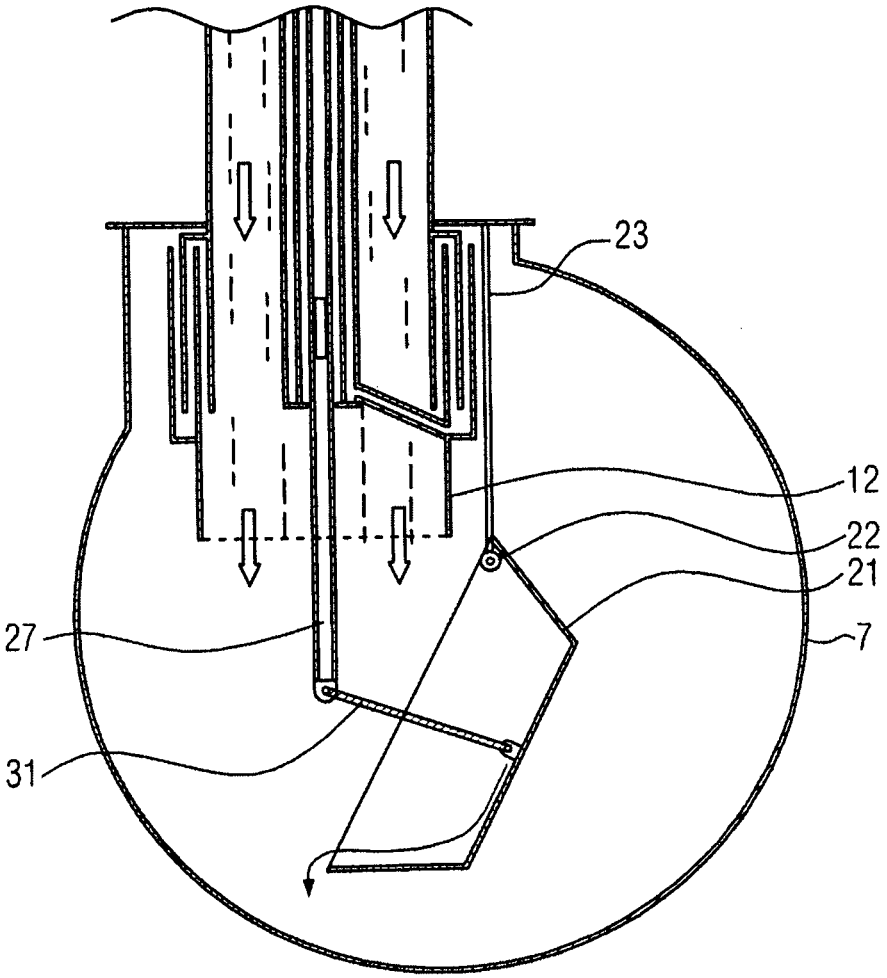
FIG. 5 shows a fragmentary vertical section through the lower part of the device according to FIG. 1 with an immersion cup that has been pivoted downwards.

FIG. 5 shows how the immersion cup 21 is emptied. When the immersion cup is tilted by means of the actuator 28, not only the water is poured out but, together therewith, all the suspended solids and contaminations contained therein.

Figure 6:
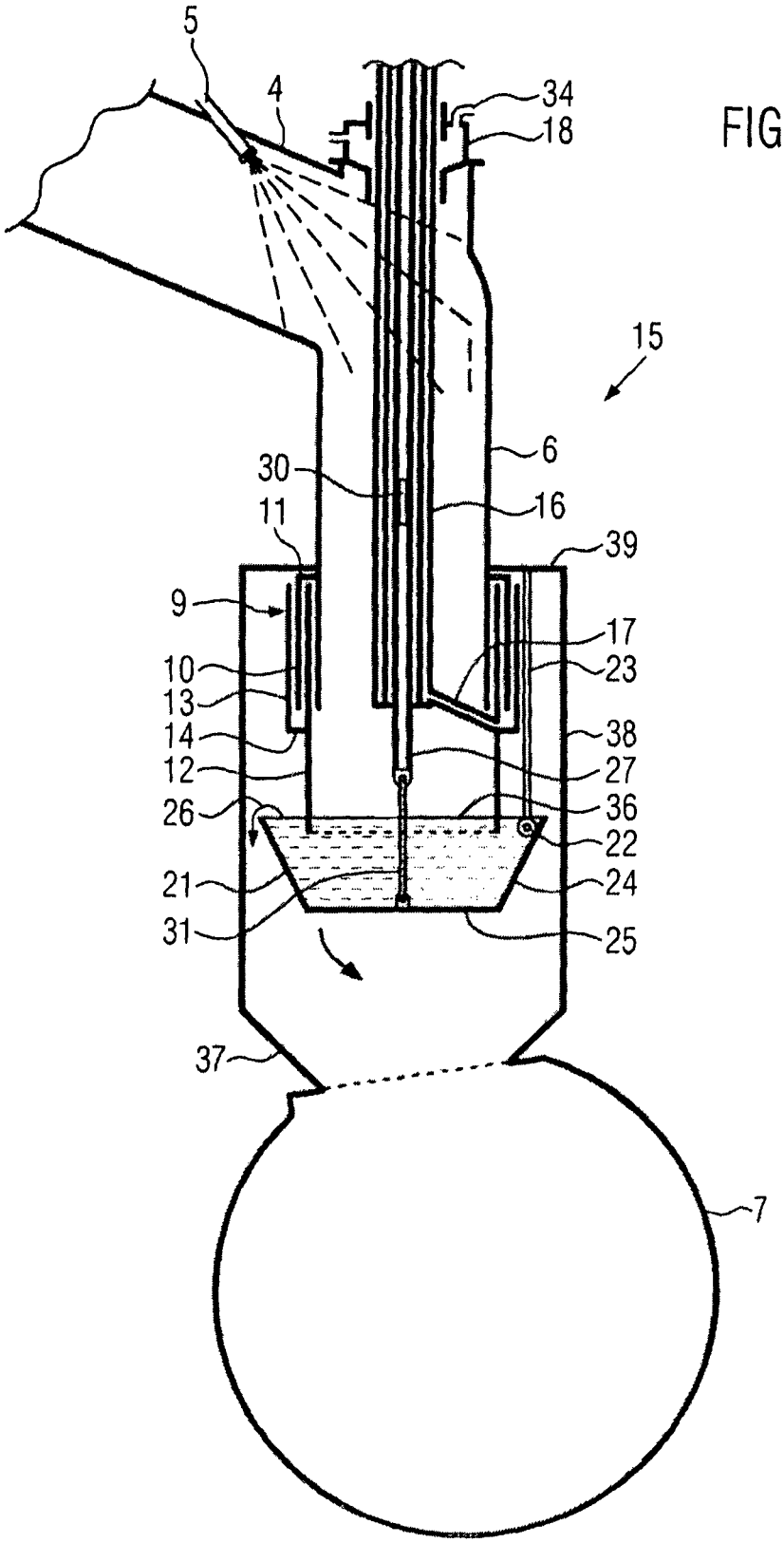
FIG. 6 shows a fragmentary vertical section through a first embodiment of the device according to the present invention, in the case of which the pressure regulating device is not disposed within the collecting main but within the rising-pipe bend.

FIG. 6 shows a variant of the present invention in the case of which the pressure regulating device is arranged not in the collecting main 7 but in the rising-pipe bend 4, which may e.g. be extended in length and width for this purpose. Identical parts are provided with identical reference numerals.

Whereas in the above described embodiments the regulating means projects into the collecting main, it now ends within the rising-pipe bend, or rather within the extension 38 of the vertical portion 6 of said rising-pipe bend. The extension is broader than the vertical portion 6, it is located between the rising-pipe bend 4 and the collecting main 7 and it tapers e.g. towards the collecting main 7. The upper end of the extension 38 is provided with a closure plate 39 by means of which it is fixed to the vertical portion 6. Also the suspension 23 of the immersion cup 21 is arranged on said closure plate. At the lower end thereof the extension terminates in a taper 37, which also provides the connection to the collecting main 7.

The width of the extension 38 is sufficiently large for accommodating therein the pressure regulating device. The fundamental structural design of this embodiment corresponds, however, to that of the previously described embodiment. The only difference is to be seen in the fact that it is arranged within the rising-pipe bend.

The advantage of this variant is that already existing coke ovens can be retrofitted more easily, since there is no necessity of changing the collecting main. Especially in the case of collecting mains that are not sufficiently large, it will be advisable not to change these collecting mains and to provide e.g. the rising-pipe bend with an extension of increased width, which can then be used for accommodating therein the regulating device.

The present invention also allows the water labyrinth seal to be supplemented or replaced by a simple water seal or by some other kind of seal.

The invention claimed is:

1. A device for regulating or controlling an individual gas pressure of each individual oven of a coke oven battery, the device comprising:

a rising-pipe bend;

a water seal;

an immersion cup;

an actuator;

an immersion pipe that extends above the immersion cup and that is associated with a lower end of the rising-pipe bend via the water seal, the immersion pipe being supported such that it is vertically adjustable by means of the actuator so that the immersion pipe is immersible to different depths into the immersion cup for causing a change in pressure; and a sleeve arranged in the rising-pipe bend which serves to position the immersion pipe, wherein a lower end of the sleeve is connected via at least one conduit to the water seal, and wherein a water supply, for feeding the water seal, and the actuator are provided at an upper end of the sleeve, outside the rising-pipe bend.

2. The device according to claim 1 wherein the water seal is a water labyrinth seal.

3. The device according to claim 1 wherein the rising-pipe bend is configured to project into a collecting main.

4. The device according to claim 1 wherein the rising-pipe bend projects into a collecting main.

5. The device according to claim 1 wherein the immersion cup has an overflow edge and is configured to be filled up to the edge when the device is in operation.

6. The device according to claim 1 further comprising a positioning means arranged in the sleeve for positioning the immersion cup.

7. The device according to claim 6 wherein the positioning means is provided with an actuator at an upper end thereof.

8. The device according to claim 6 wherein the positioning means is implemented as a tube and has at an upper end thereof a water supply.

9. The device according to claim 6 wherein the positioning means has at least one water discharge opening.

10. The device according to claim 6 wherein a lower end of the positioning means is articulated on the immersion cup by means of a connection piece.

11. The device according to claim 6 wherein the positioning means is sealed off from the sleeve in a vertically variable manner.

12. The device according to claim 1 wherein the sleeve is sealed off from the rising-pipe bend in a vertically variable manner.

13. A device for regulating or controlling an individual gas pressure of each individual oven of a coke oven battery, the device comprising:

a rising-pipe bend;

a water seal;

an immersion cup, the immersion cup having an overflow edge;

an actuator;

an immersion pipe that extends above the immersion cup and that is associated with a lower end of the rising-pipe bend via the water seal, the immersion pipe being supported so that it is vertically adjustable by the actuator so that the immersion pipe is immersible to different depths into the immersion cup for causing a change in pressure;

a sleeve arranged in the rising-pipe bend for positioning the immersion pipe; and a collecting main configured to receive water from the immersion cup.

14. The device according to claim 13 wherein the immersion cup comprises an overflow edge so that a constant water level may be established by continuously filling water in the immersion cup, wherein a lower end of the immersion pipe is adjustable with respect to the constant water level to regulate or control the gas pressure.

15. The device according to claim 13 wherein a lower end of the sleeve is connected via at least one conduit to the water seal.

16. The device according to claim 13 wherein the immersion cup is positioned in the collecting main.

17. The device according to claim 13 wherein the immersion cup is positioned outside of the collecting main.

18. The device according to claim 13 wherein a lower end of the sleeve terminates above a lower end of the immersion pipe.

19. The device according to claim 18 wherein the sleeve extends above the immersion pipe.

20. The device according to claim 13 wherein the rising-pipe bend includes a vertical portion and an angled portion that extends at an angle with respect to the vertical portion, and wherein the sleeve extends above the vertical portion of the rising pipe bend.

21. A device for regulating or controlling individual gas pressure of individual ovens of a coke oven battery, the device comprising:

a rising-pipe bend;

an immersion pipe sealingly arranged on a lower end of the rising-pipe bend, the immersion pipe being positionable so that a lower end of the immersion pipe is immersible in water;

an immersion cup located below the immersion pipe, the immersion cup having an overflow edge so that a constant water level is establishable by continuously filling water in the immersion cup, wherein the lower end of the immersion pipe is adjustable with respect to the constant water level so as to regulate or control the gas pressure; and a collecting main configured to receive water from the immersion cup.

22. The device according to claim 21 wherein the immersion cup is positioned in the collecting main.

23. The device according to claim 21 wherein the immersion cup is positioned outside of the collecting main.

24. The device according to claim 21 further comprising a positioning means connected to the immersion cup for positioning the immersion cup, wherein the positioning means comprises a tube for discharging water to the immersion cup.

25. A method of regulating or controlling an individual gas pressure of each individual oven of a coke oven battery using the device according to claim 21, the method comprising:

continuously filling with water the immersion cup located below the immersion pipe so that the water flows over the overflow edge and establishes the constant water level with respect to which the lower end of the immersion pipe is adjusted so as to regulate or control the gas pressure; and receiving in the collecting main the water from the immersion cup.

26. The method according to claim 25 wherein the rising-pipe bend projects into the collecting main.

27. The method according to claim 25 wherein the rising-pipe bend has arranged therein a sleeve for use in positioning the immersion pipe.

28. The method according to claim 27 wherein a positioning means is arranged in the sleeve for positioning the immersion cup.

29. The method according to claim 28 wherein the positioning means comprises a tube that projects beyond a top of the sleeve, and an upper end of the tube is connected to a water supply.

* * * * *